US006485016B1

(12) United States Patent
Hummel et al.

(10) Patent No.: US 6,485,016 B1
(45) Date of Patent: Nov. 26, 2002

(54) STACK CHANGING DEVICE

(75) Inventors: Peter Hummel, Offenbach (DE); Robert Ortner, Alzenau (DE)

(73) Assignee: MAN Roland Druckmaschinen AG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/367,144

(22) PCT Filed: Feb. 3, 1998

(86) PCT No.: PCT/EP98/00568

§ 371 (c)(1),
(2), (4) Date: Aug. 5, 1999

(87) PCT Pub. No.: WO98/34865

PCT Pub. Date: Aug. 13, 1998

(30) Foreign Application Priority Data

Feb. 5, 1997 (DE) ..... 197 04 285

(51) Int. Cl.[7] ..... B65H 1/26
(52) U.S. Cl. ..... 271/157; 414/795.8
(58) Field of Search ..... 271/157, 158, 271/159; 414/795.8, 790.8

(56) References Cited

U.S. PATENT DOCUMENTS

| | | | | | |
|---|---|---|---|---|---|
| 2,690,337 | A | * | 9/1954 | Halahan et al. | 271/159 |
| 4,021,710 | A | * | 5/1977 | Fichte et al. | 271/159 X |
| 4,174,831 | A | * | 11/1979 | Marass et al. | 271/159 |
| 5,011,126 | A | * | 4/1991 | Suzuki et al. | 271/159 X |
| 5,295,681 | A | * | 3/1994 | Blaser | 271/159 X |
| 5,405,130 | A | * | 4/1995 | Maas | 271/159 X |
| 5,538,238 | A | * | 7/1996 | Filsinger | 271/159 |
| 5,803,446 | A | * | 9/1998 | Leuthold et al. | 271/159 X |

FOREIGN PATENT DOCUMENTS

| | | | | |
|---|---|---|---|---|
| DE | 11 10 659 B | | 7/1961 | |
| DE | 26 37 086 | * | 12/1977 | 271/159 |
| DE | 39 31 710 A | | 4/1990 | |
| DE | 42 03 500 A | | 8/1993 | |
| DE | 195 20 772 C | | 10/1996 | |

* cited by examiner

*Primary Examiner*—Janice L. Krizek
(74) *Attorney, Agent, or Firm*—Leydig, Voit & Mayer, Ltd.

(57) ABSTRACT

In a device for changing a sheet stack in a sheet feeder, remaining-stack bars (7A, 7B) of different thicknesses are used to improve operation. Upon combination of a remaining-stack (H) with a H. sheet-stack (S), they are placed in graduations on a pallet (P) and successively pulled from the stack area.

21 Claims, 7 Drawing Sheets

STACK CHANGING DEVICE

FIELD OF THE INVENTION

The present invention relates to sheet-fed printing machines and, more particularly to an improved stack changing device for sheet feeders of sheet-fed printing machines.

BACKGROUND OF THE INVENTION

It is a known practice, in sheet feeders for sheet-fed printing presses or other sheet-processing machines, to provide arrangements for automated stack change. These may consist of rack-type structures, so-called remaining-stack carrying devices, which are provided with thrusting and lifting drives for the horizontal and vertical movement. Such so-called non-stop stack changers are suited, for example, during the printing of paper sheets, i.e. in machine running, to take over remainders of finished sheet stacks from, for example, a pallet with grooves, and to deposit them again on a new sheet stack subsequently installed in the sheet feeder. Known devices are distinguished by high constructive and assembly expenditure and require special constructions of the sheet feeders. Further, devices are used here, the remaining-stack carrying device of which have a rack engaging into the grooves of the pallet. This rack is to be removed in the joining of the remaining stack with the newly installed sheet stack as a whole between the two stack parts. This involves high drive forces and places very strong stresses on the sheets lying next to the section point. Furthermore, restraining means are to be provided which prevent a shifting of the stack parts, and, in the process, severely strain the stack edges. Furthermore, the operation of the sheet feeder itself is severely hindered or even rendered impossible. The sheet flow is difficult to control in the changing operation, so that waste sheets result again and again.

Devices have already been developed that partly avoid some of the disadvantages described.

Thus, from DE 393 1710 C2 there is known a non-stop sheet feeder for sheet-fed rotary presses. It has a remaining-stack carrying device which is arranged underneath a conveyor table leading from the sheet feeder to the sheet-fed rotary press. The remaining-stack carrying device has a closed frame on which non-stop bars are arranged, which can be driven as piston rods of individual cylinders by means of a pressure medium, and which are drivable into grooves of a pallet carrying a sheet stack. The non-stop rods lie, in the driven-in state, on both sides of the frame and are to be removed successively from the zone of the sheet feeder. While the rods have individual drive cylinders, the patent discloses nothing about the sequence of operation. The bridging of the gap conditioned by the non-stop bars between main stack and remaining stack is an obstacle to a faultless continuous processing in the unification of the stacks.

From DE 4 203 500 A1 a sheet feeder is known. It has, parallel to the sheet feeder and allocated to this on the face side, an auxiliary stack-carrying device as an independent component. Then, over a common drive, individually drivable pointed bars are provided which can be introduced into grooves of a pallet carrying a sheet stack. The drive has individual chain gears which are couplable onto the respective pointed bars. For the guidance and accessibility of the chain drives, special constructive measures are required. The chain drives completely block the space in front of the sheet feeder, so that the latter is not accessible. In the stack changing, it is provided to remove the pointed bars in the joining of main stack and remaining stack, first on the outside, then in the middle and lastly in the zone between the already pulled pointed bars out of the stack and remaining stack, so that a gentle depositing of the remaining stack of the sheet stack results. This, however, is possible with the requisite precision only in the case of heavy materials such as sheets of metal, since the sheets bulge in different direction and must sink over a large gap that is formed by the pointed bars.

Finally, from DE 19520772 C1 there is known a non-stop sheet feeder for printing presses with fork bars movable in and out. In this feeder on both sides of the stack zone there are provided units of fork bars movable transversely to the sheet transport direction. The fork bars are joined with one another and are drivable in common into grooves of a pallet carrying a sheet stack. From there they can take over an auxiliary stack in order to bridge the time period up to the supplying of a new sheet stack. For the preliminary approach of the main stack and of the remaining stack before the final joining, the fork bars are rectangular in cross section and turnable about a longitudinal axis. There the fork bars thrust in first in the upright orientation, in order to be able to carry as great a load as possible. For the approach they are then rotated through 90 degrees, so that the main stack and the remaining stack approach the value of the thickness of the narrower side to each other. In the turning of the fork bars measures have to be taken in order to avoid a shifting of the sheets lying next to the fork bars. This has proved in practice to be virtually unfeasible.

Further, from DAS 105 297 there is known a sheet feeder with several stack-lifting mechanisms. It has a fork-shaped remaining-stack carrying device, which is provided with remaining-stack bars slidable into grooves of a pallet. The device makes possible the take-over of a remainder of a sheet stack from the pallet for the continuous feeding of the sheets while a new sheet stack is installed into the sheet feeder. The remaining-stack device is connected with a separate lifting mechanism parallel to the main-stack lifting mechanism inside the sheet feeder, so that the remaining stack is continuously liftable. The operating range of the remaining-stack carrying device is restricted. The remaining-stack carrying device hampers access to the sheet feeder.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which allows for simple and continuous stack changing with undisturbed sheet transport and no wasted paper.

The present invention provides these and other advantages and overcomes the drawbacks of the prior art by providing a stack changing device which utilizes an improved method and device for receiving a remaining-stack and transferring the remaining stack to a newly fed-in sheet stack.

It is advantageous that carrying and spacing bars movable independently from one another are provided in the device, which are pulled out of the stack zone not simultaneously but intermittently for the unburdening of the sheet material. There can be provided preferably a different height of the two types of bars, which generates a smooth depositing movement of the remaining stack on the sheet stack. The pulling movement of the bars has no influence on the remaining stack resting on it, so that the directly affected paper sheets are spared, since only slight or no retaining forces are required. In particular the continuous removal of the remaining-stack bars from inward, outward and in two states makes possible a gentle depositing of the remaining stack on the sheet stack. Moreover, it is advantageous to make the remaining-stack bars, according to type, of different length, so that an improved working run-off results.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFERRED EMBODIMENTS

Figure 1:
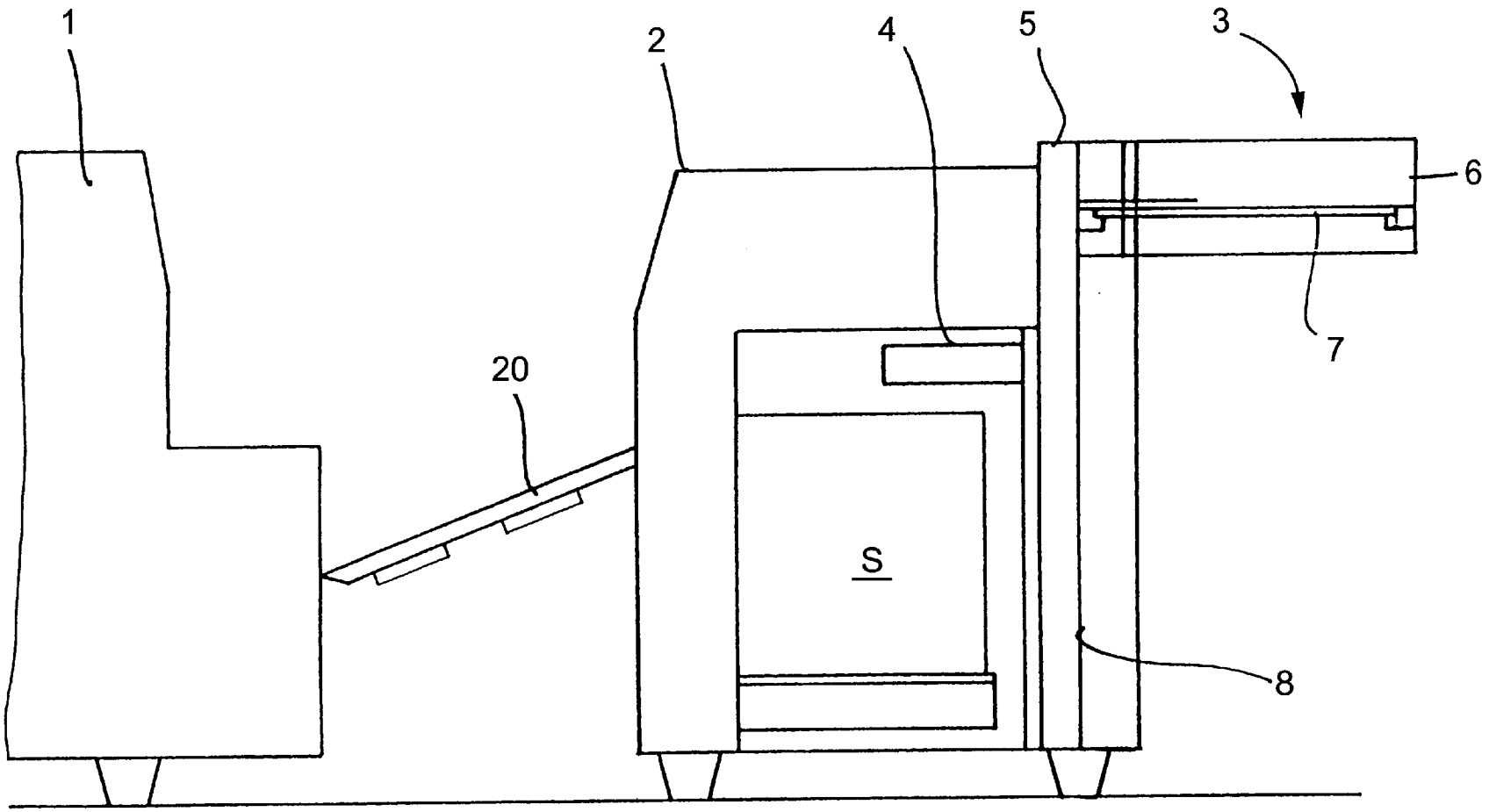
FIG. 1 is a side elevation view of an illustrative embodiment of a sheet feeder constructed in accordance with the present invention.

In FIG. 1 there is represented a sheet feeder 2 connected with a sheet-processing machine, for example with a. sheet-fed printing press 1. In the sheet feeder 2 a sheet stack S is installed for processing. The sheet stack S can be lifted in the rhythm of the sheet processing by means of a main-stack lifting unit which is not represented in detail here. The sheets of the stack S are taken one by one or singled from its upper side and fed to the sheet-fed printing press 1 as a sheet stream. In the sheet feeder 2 there is provided a sheet-singling arrangement 4, which is provided with a whole number of multiple operating elements for format-dependent adjustments and for adjustments of the supplying with either suction or blast air. The operating elements serve for the attuning of the various functions of the sheet-singling device 4 to the proper transport of the sheets from the sheet feeder 2 to the sheet-fed printing press 1. In the sheet feeder 2 there is arranged, further, a remaining-stack carrying device 3, which is assigned to the face side away from the sheet-fed printing press 1 of the sheet feeder 2. The remaining-stack carrying device 3 is provided with a rack or frame 6, in which the remaining-stack bars 7 are stored longitudinally shiftably. By means of the frame 6, the remaining-stack carrying device 3 is suspended on a remaining-stack lifting unit 5. The remaining-stack lifting unit 5 is indicated here only in its position, but not in details. The remaining-stack lifting unit 5 serves to hold a remaining stack H in the sheet feeder 2 and to raise it in the rhythm of the sheet processing. For this reason the remaining-stack lifting unit 5 is also controllable synchronously with the main stack-lifting device. The remaining-stack lifting unit 5 consists of vertical guide rails 8 connected with the sheet feeder 2, on which (rails) the frame 6 is guided, and has, for example, lift chains by means of which the remaining-stack carrying device 3 is raisable or lowerable.

Figure 2:
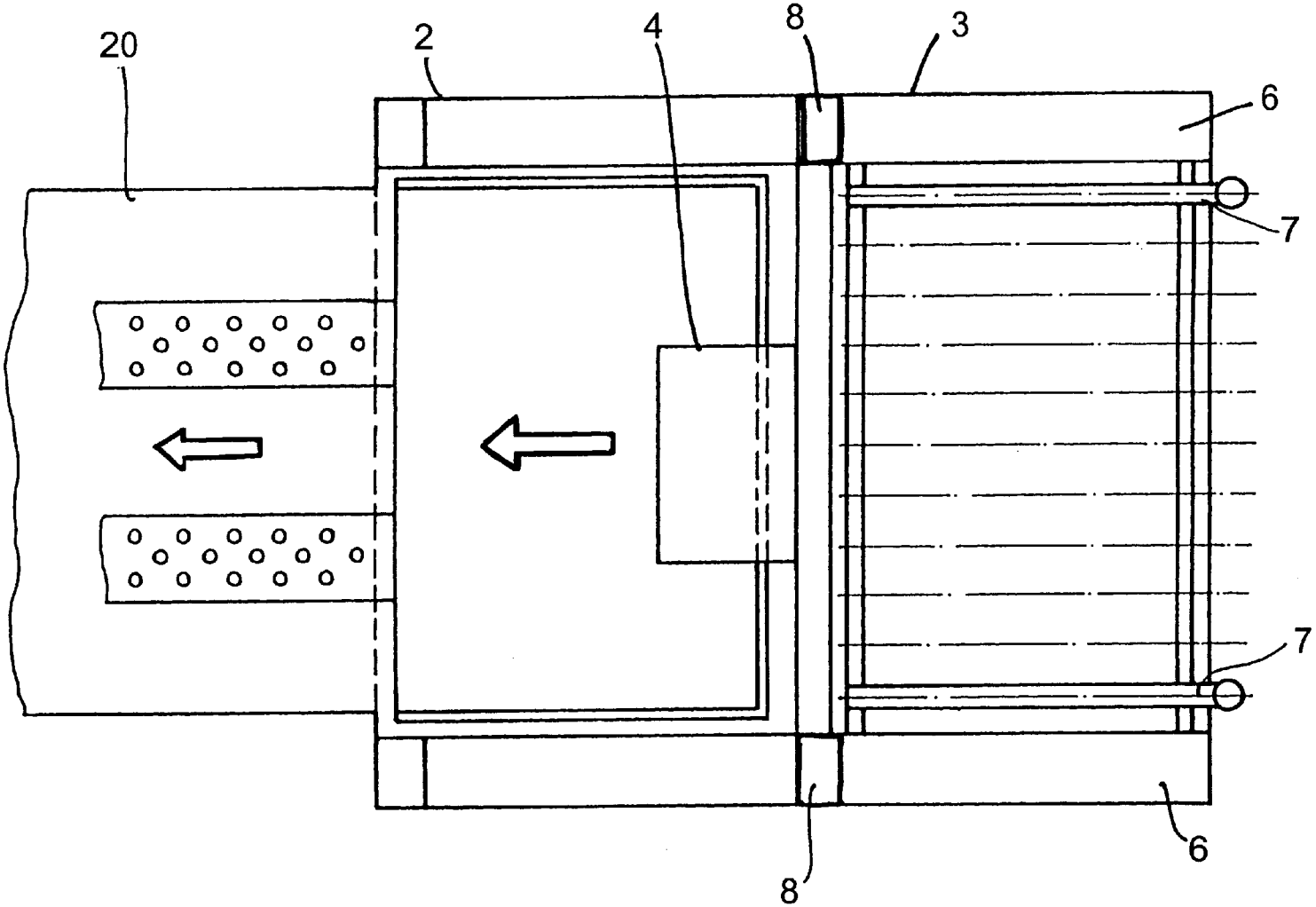
FIG. 2 is a plain view of a sheet feeder.

In FIG. 2 the sheet feeder 2 is shown in a top view. Upon the sheet feeder 2 there follows in the sheet running direction indicated by arrows, a so-called conveyor table 20, over which the sheet stream generated by the singling is transported-to the sheet-processing machine, for example the printing press 1. Further, the position of the sheet-singling device 4 is recognizable in allocation to the rear edge of the sheet stack S. The orientation of the remaining-stack bars 7 is represented in its arrangement in respect to the sheet feeder 2, only the two outer remaining-stack bars 7 being represented, and the others being indicated with effect lines. The position shown is, for example, the readiness position before the initiation of a changing process, or the waiting position outside of the operating range of the sheet feeder 2. The remaining-stack bars 7 are guided there within the remaining-stack carrying device 3, so that in the position shown they occupy a horizontal position outside the zone of the sheet feeder 2. The remaining-stack carrying device 3 with its frame 6 is guided by means of the guide rails 8 on the sheet feeder 2 and is vertically movable. The remaining-stack lifting unit 5 is again indicated only in its position and is located on the upper side of the guide rails 8, for example on the frame of the sheet feeder 2, it engages from there on the frame 6 of the remaining-stack carrying device 3 and moves this stack upward and downward on the guide rails 8.

From FIG. 1 it is evident that the remaining-stack carrying device 3 is installed by means of the guide rails 8 directly into the sheet-feeder 2. On the one hand, the remaining-stack lifting unit 5 is movable liftably and lowerably during the supplying of the printing press 1 with sheets and, on the other hand, the remaining-stack carrying device 3 is movable outside of the processing zone for the stack change proper. Through this arrangement in the sheet feeder 2, the latter is very well accessible from its face-side operating side.

Figure 3:
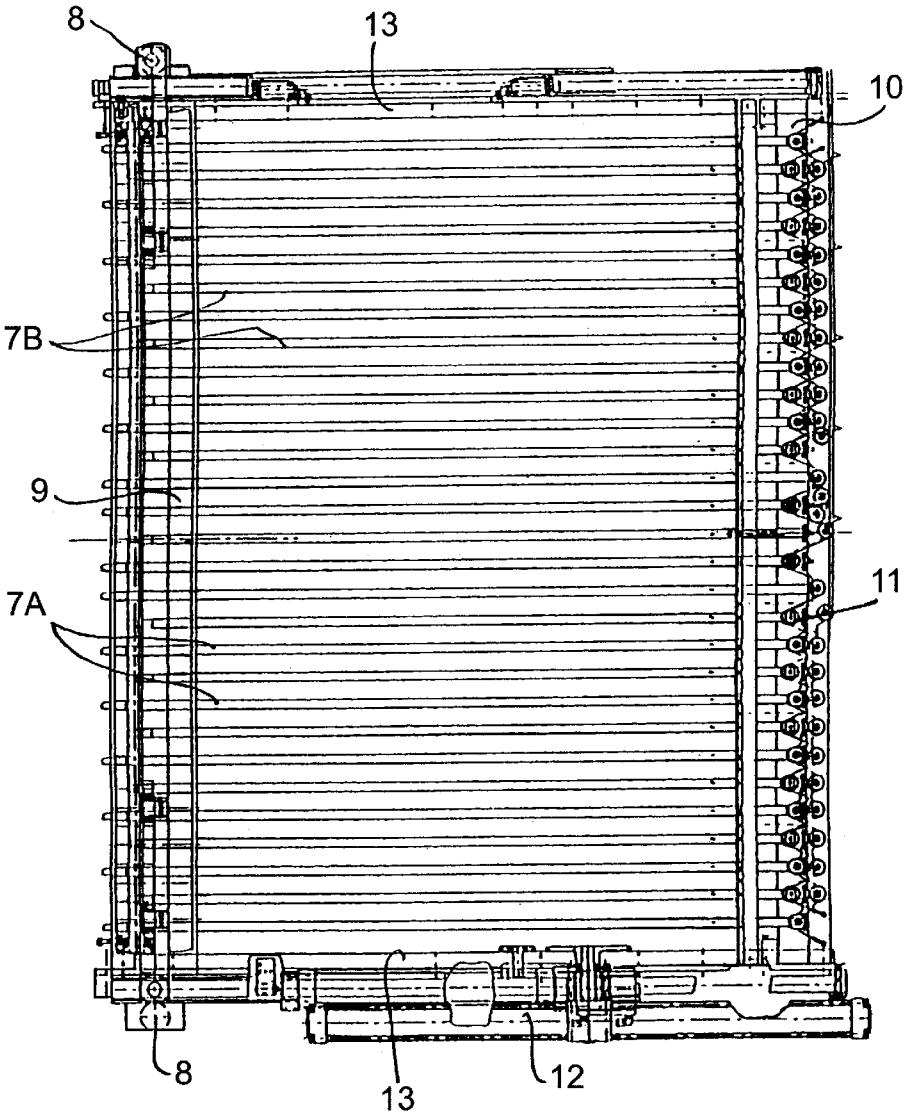
FIG. 3 is a plain view of a stack-changing device of the sheet feeder of FIG. 1.
Figure 3:
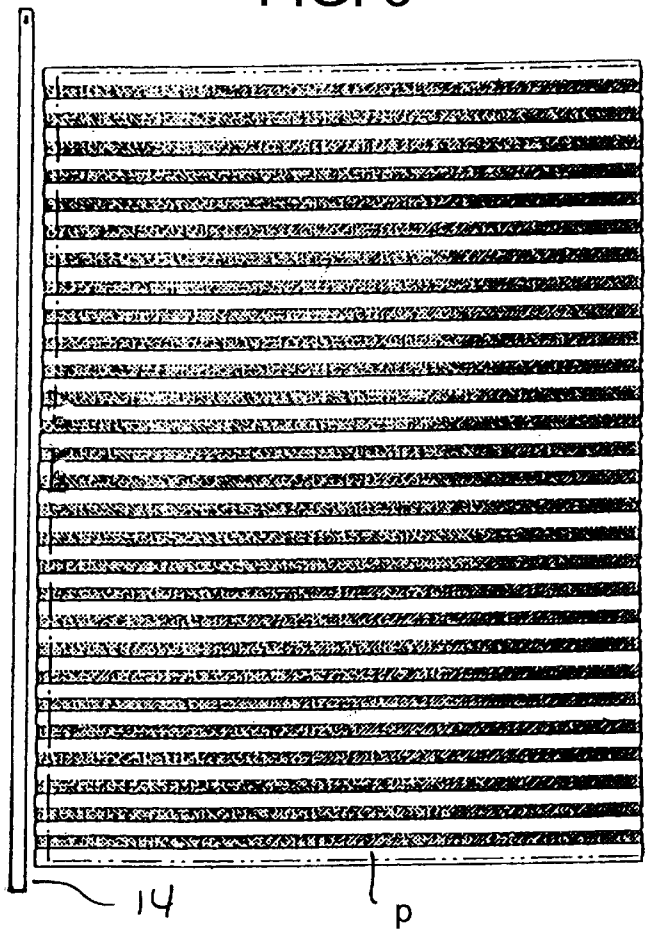

In FIG. 3 there is shown a complete representation of the remaining-stack carrying device 3. The frame 6 is vertically guided on the guide rails 8. In the frame 6 in a front carrying rail 9 there are guided the remaining-stack bars 7 in the form of carrying bars 7A and spacer bars 7B. On a rear carrying rail 10 there is arranged a pulling drive 11 for the singled pulling of the carrying bars 7A and spacing bars 7B. It will be appreciated by one skilled in the art that various known pulling drives may be used for individually pulling the carrying bars 7A and spacing bars 7B, including gear drive chains such as shown in the above-referenced DE 4203 500 A1 or individual drive cylinders, such as shown in the above-referenced DE 39 171 0 C. Moreover, as will become apparent herein, such known drives may be operated to simultaneously pull more than one carrying bar 7A or spacing bar 7B at a time.

In FIG. 3, the carrying bar 7A and spacing bar 7B are shown in the waiting position. Further, there are provided on both sides drives 12 for the longitudinal shifting of the rear carrying rail 10 on guide rails 13 of the frame 6. The drives 12 determine the position of the rear carrying rail 10 at the rear end or within the frame 6. The front carrying rail 9 is firmly joined with the frame 6. The carrying bars 7A and the spacing bars 7B are of different height. The carrying bars 7A, for example, are about twice as high as the spacing bars 7B. By height there is meant the extension of the carrying bars 7A or spacing bars 7B, respectively, perpendicular to the extended plane of the remaining-stack carrying device 3. The effect of this measure will still be thoroughly shown in the following representations.

The carrying bars 7A and spacing bars 7B can be of equal length. In a preferred form of execution, however, the carrying bars 7A are longer than the spacing bars 7B. The carrying bars 7A serve, in the takeover of a remaining-stack H, first of all for the load reception, and they are to be dimensioned correspondingly, in which case the load is to be led off into a further carrying means (see FIG. 4).

Figure 4:
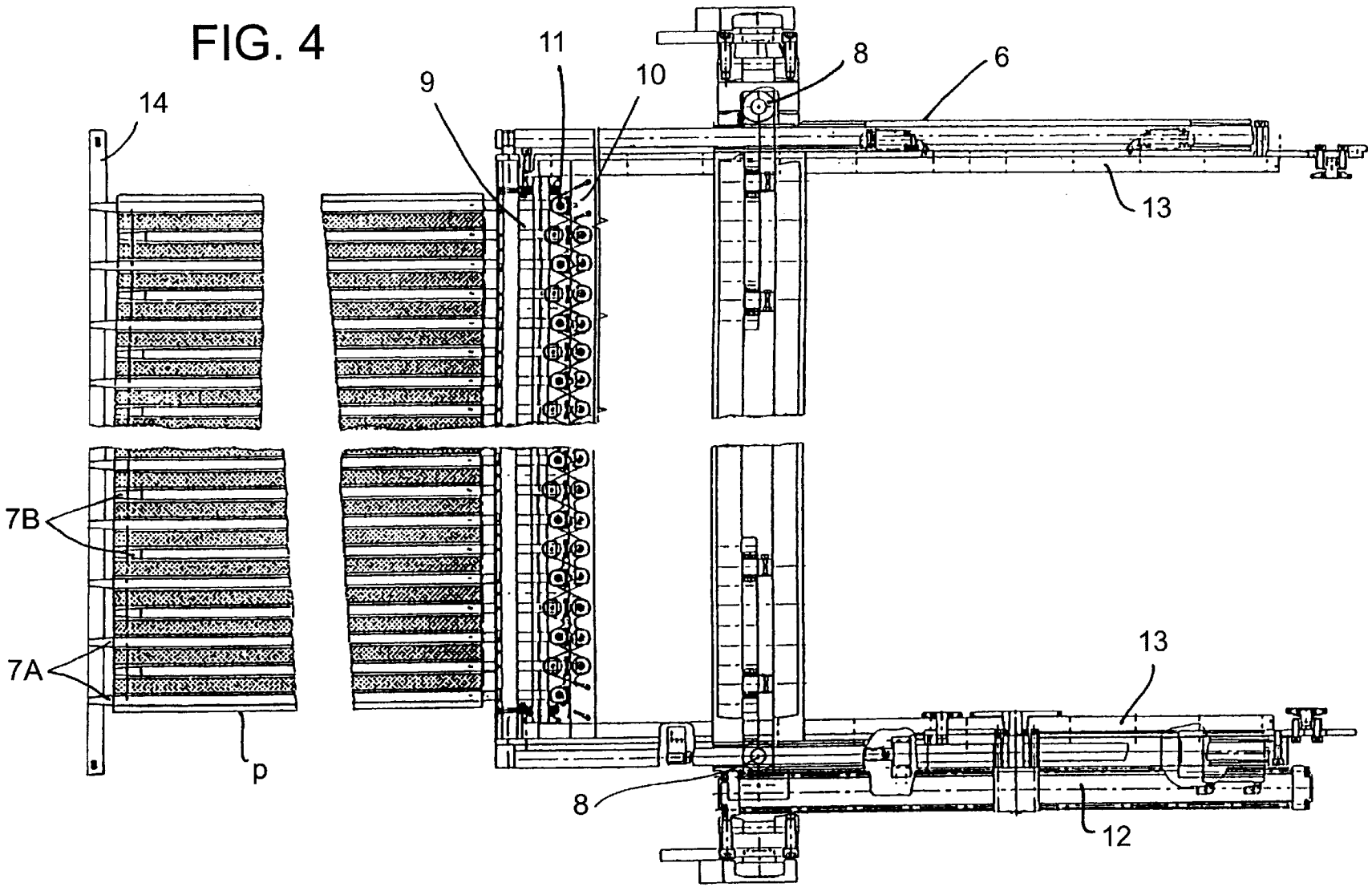
FIG. 4 is a plan view showing the stack-changing device of FIG. 3 taking over a remaining stack.

In FIG. 4 the remaining-stack carrying device 3 is shown functioning. The carrying bars 7A, as well as the spacing bars 7B are thrust forward by means of the drives 12 together with the rear carrying rail 10 opposite the front carrying rail 9 and introduced into grooves of a pallet P carrying the sheet stack S. Front carrying rail 9 and rear carrying rail 10 with the pulling drive 11 now lie parallel in front of the pallet P which carries a remainder of a sheet stack S, the so-called remaining-stack H. The pallet P and the remaining-stack H are not touched there by the front carrying rail 9. The longer and higher carrying bars 7A lie on a remaining-stack lifting rail 14 on the front end (as seen in sheet running direction) in the sheet feeder 2. This remaining-stack lifting rail 14 is coupled with a lifting drive and provided for the support of the carrying bars 7A as well as their lifting movement during production. The remaining-stack lifting rail 14 and the remaining-stack lifting unit 5 are both connected for this purpose with the main stack lifting unit of the sheet feeder 2, or at least mechanically or controlably coupled with one another in such manner that in the stack processing, especially, however, in the bringing together of the remaining-stack H with a new sheet stack S, they can be lifted synchronously.

From FIG. 4 it is further to be learned that in the position represented of the remaining-stack carrying device 3 with carrying bars 7A and the spacing bars 7B thrust into the pallet P, the space inside the frame 6 is free and the frame 6 is open to the rear. For handling, it can be of importance that the carrying bars 7A and spacing bars 7B can be fitted into the grooves of the pallet P already early, i.e., long before the actual required changing operation. The remaining-stack carrying device 3 can then be lifted in common with the sheet stack S until the stack change actually must occur. Then the remaining-stack H need still be lifted only from the pallet P. When the remaining-stack bars 7 are again pulled, i.e., the stack unification has taken place, the remaining-stack bars 7 can immediately be driven again into the new pallet P.

The actual operation of the stack change is represented via steps in FIGS. 5 to 8.

A precondition is that in the sheet feeder 2 a sheet stack S is continuously raised during the processing, i.e. singling of the sheets on the upper side of the sheet stack S and their transport in the sheet stream to the printing press 1. There, a point is reached at which there is present only a remaining stack H of the sheet stack S that has a predetermined height. In dependence on the processing speed there still remains then only a certain span of time until the remaining stack H is likewise used up. Within this span of time, a new stack sheet S must be available in the sheet feeder 2, otherwise the operating process must be interrupted. For this reason at the predetermined time point, which depends on the height of the remaining stack H from the sheet stack S, the course to the stack change is set in operation.

Figure 5:
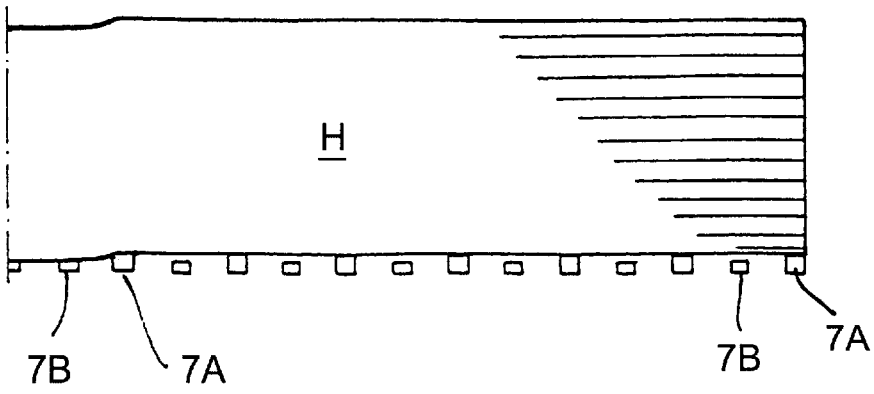
FIGS. 5 to 8 are schematic side elevational views showing an illustrative stack changing process according to the present invention.

In FIG. 5, it is schematically shown how a remaining stack H, respectively the remainder of the sheet stack S, is lifted from the pallet P. This occurs by the means that the remaining-stack bars 7 are slid into the grooves of the pallet P and the pallet P is lowered by means of the main stack lifting mechanism. Then, at first, only the higher and lengthened carrying bars 7A, resting as represented in FIG. 4 on the remaining-stack lifting rail 14, carry the remaining stack H. The lower spacing bars 7B lie free, but guided by the carrying rails 9, 10. The carrying rails 9 and 10 are, at this point in time, parallel to one another in a compact position with small spacing with respect to the rear edge of the remaining stack H. It can be provided that in relation to the inside-lying stack middle, the thinner spacing bars 7B are lengthened for switching functions and likewise rest on the remaining stack lifting rail 4. Likewise, all the spacing bars 7B can be made as emplaceable on the remaining-stack lifting rail 14.

Figure 6:
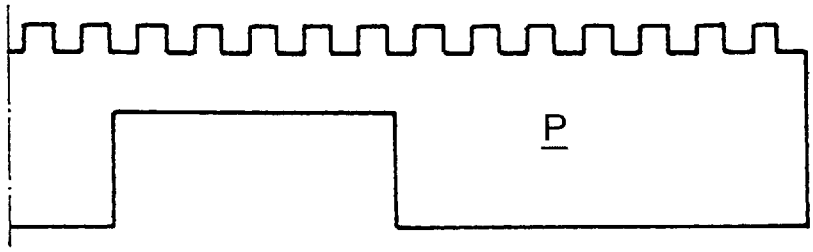
Figure 6:
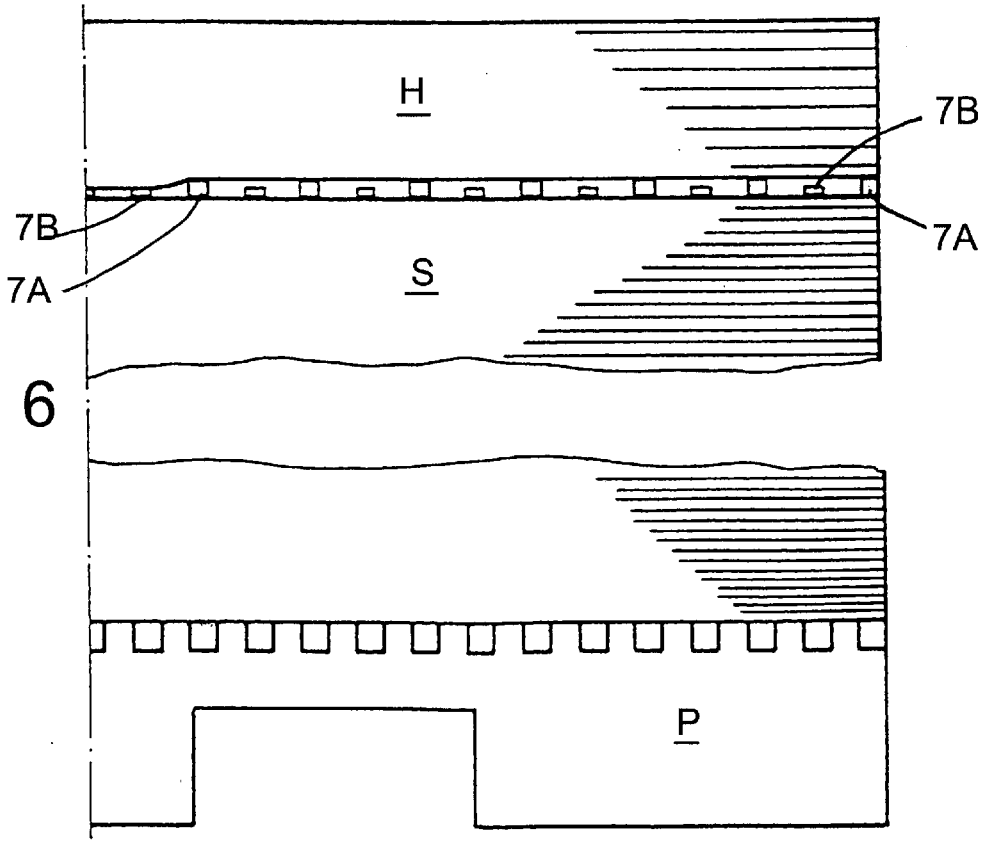

In FIG. 6 it is represented how a new sheet stack S is raised from underneath against the remaining-stack carrying arrangement 3. There the carrying bars 7A stand in contact from above with the remaining-stack H and from underneath with the sheet stack S. The carrying bars 7A are therefore firmly guided. Here it is to be considered from the viewpoint of control techniques, that the lifting movement of remaining stack H and sheet stack S, as already executed further above, must be synchronized. In the running of the sheet stack S against the carrying bars 7A, for example, a sensor in the remaining-stack carrying bars 7A, for example, a sensor in the remaining-stack rail 14 may initiate the synchronization of the lifting movements of remaining stack H and sheet stack S, and also the now beginning pulling movement. In a variant also the inner spacing bars 7B can already stand in contact with the two stack surfaces. Then exclusively in the middle no carrying bars 7A would be present and the remaining-stack H would already be lowered there by the height difference between the carrying bars 7A and spacing bars 7B.

Figure 7:
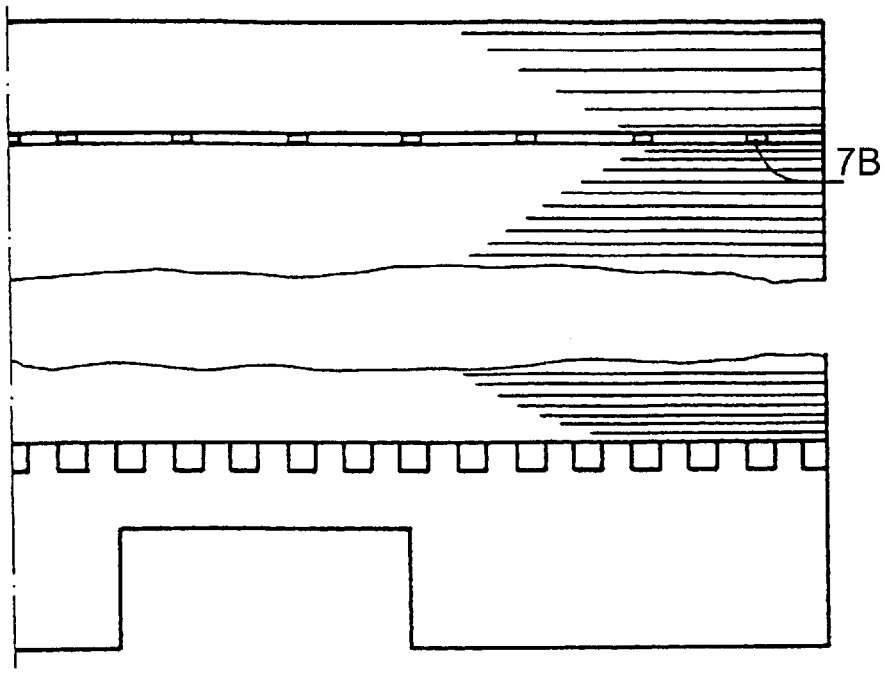

In FIG. 7 it is shown that the thicker carrying bars 7A were already removed. This process is feasible, for example, by means of individual drives, but there can also be spanned drive connections, for example, pulling means, between the pulling drive 11 arranged on the rear carrying rail 10 and the carrying bars 7A or the spacing bars 7B. For the pulling, the carrying bars 7A are then connected individually with the pulling drive 11, in which operation the carrying bars 7A, for example, are directly freed in pairs and thus also pulled in pairs by means of the pulling drive 11 out of the space between remaining stack H and sheet stack S until they again lie on the rear carrying rail 10. The pulling sequence is preferably controlled in such manner that the carrying bars 7A are pulled in the sequence from the middle of the stack outward. There consequently the remaining stack H sinks slowly outward from the stack middle to the stack edges onto a second plane which is defined by the spacing bars 7B. This position is represented in FIG. 7: in the simplest case the spacing bars 7B are shorter than the carrying bars 7A and in the shown position they execute, as it were, still only a control function for the continuous stack unification, since they no longer rest on the remaining-stack lifting rail 14 and thus also cannot divert any load. It can also be provided, however, that the spacing bars 7B are of equal length with the carrying bars 7A and then also rest on the remaining-stack lifting rail 14. This can serve, for example, to pick up the end of the pulling movement on the remaining-stack lifting rail 14 executed as a scanning rail and does impair the control function for the stack unification. Only the time expenditure for the pulling becomes somewhat greater.

Figure 8:
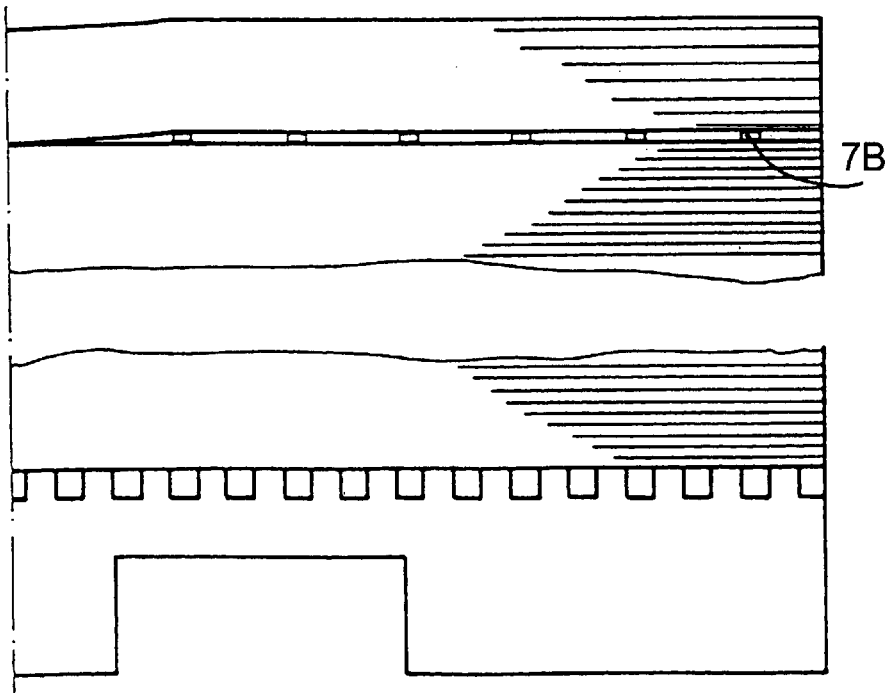

In FIG. 8, finally, there is represented the initiation of the conclusion of the pulling movement. Now in the same rhythm, i.e. preferably in pairs, the thin spacing bars 7B which, after all, still only separate the remaining stack H from the sheet stack S, but no longer exercise any lifting or carrying function any more, for example, likewise are pulled outward in pairs from the stack middle to the stack edges. There the auxiliary stack H now again, in likewise continuous movement, comes to lie on the sheet stack S, without the result that the remaining stack H would move with respect to the sheet stack S and thereby be jammed by forced means or would have to be fixed in relation to the sheet stack S. This holds both in the direction of the pulling movement of the remaining-stack bars 7 toward the rear stack border as well as in transverse direction thereto, toward the later stack edges. The stack change is therewith concluded after the joining of remaining stack H and sheet stack S, and the remaining-stack carrying device 3 can be repositioned.

Figure 9:
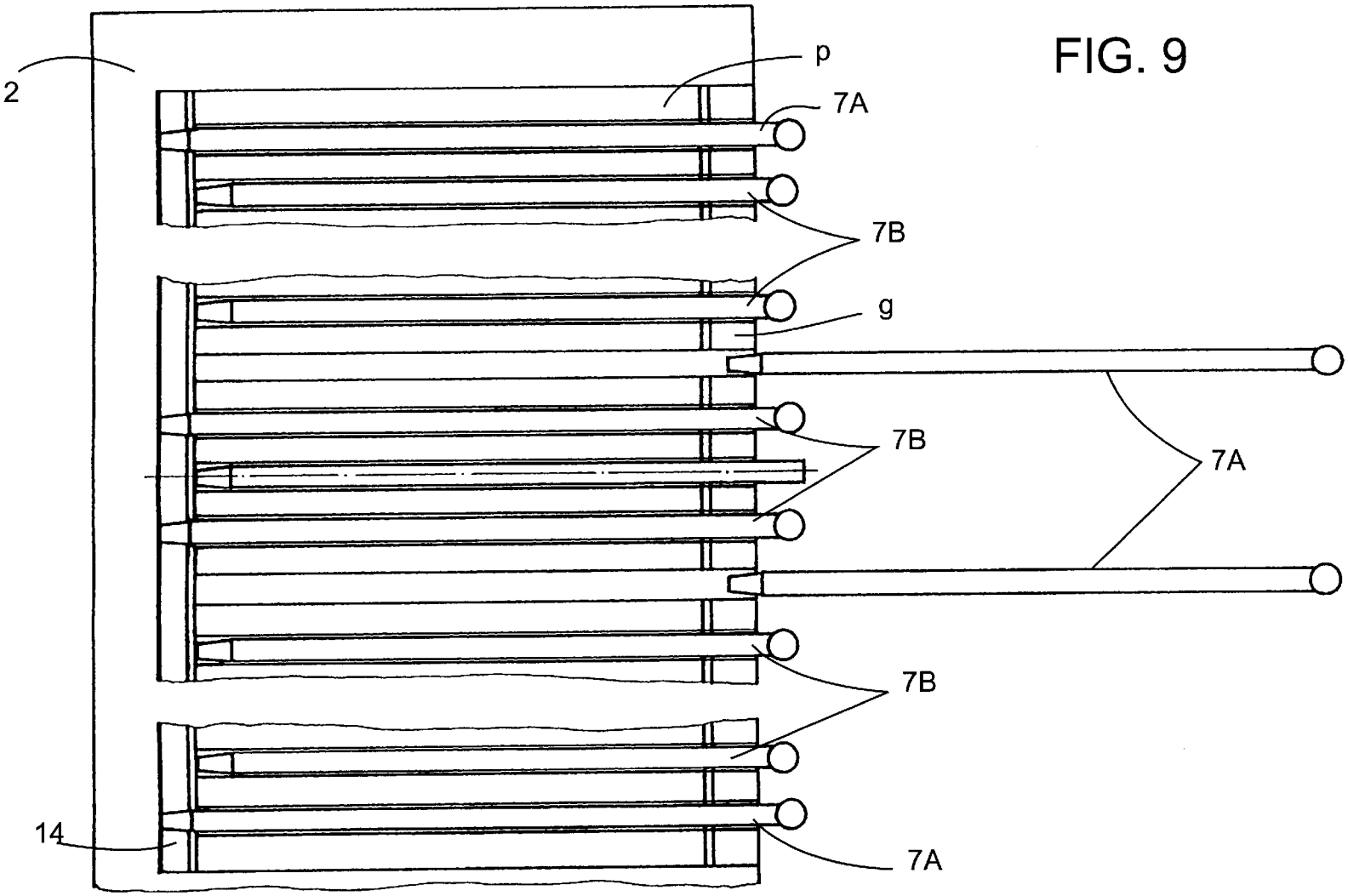
FIG. 9 is an enlarged partial plan view showing the stack-changing device during the stack change.

In FIG. 9, the connection of the pulling movement to the arrangement inside the sheet feeder 2 is once again clarified. The carrying bars 7A and the spacing bars 7B lie alternately in grooves of a pallet P (in which context one must imagine oneself as lying on the webs between the grooves of the pallet P in the normal manner of the sheet stack S). The carrying bars 7A rest there on the remaining-stack lifting rail 14. The same holds in the illustrated case for the inner spacing bars 7B, which have only half the height of the carrying bars 7A. The pulling process of the carrying bars 7A begins with the thicker carrying bars 7A lying nearest the middle of the stack, which bars, as represented, are pulled as a pair. There the auxiliary stack H in this zone comes to lie slowly on the thinner spacing bars 7B. The pulling of the thicker carrying bars 7A, and then of the thinner spacing bars 7B, occurs smoothly and in close time sequence, but always separately from one another. For this there is provided a device for controlling the pulling movement. This can be integrated directly into the pulling drive 11 for the carrying bars 7*a* or spacing bars 7B, or it can act over further control means on the pulling drive of each individual carrying bar 7A or spacing bar 7B.

The stack change proceeds, therefore, as follows:

I. On reaching a minimum height of the sheet stack S the stack-changing process is started.

II. The carrying bars 7A and the spacing bars 7B are slid in common from the frame 6 into the grooves of the pallet P underneath the sheet stack S, the sheet stack S remaining free on the rear side toward the remaining stack carrying device 3.

III. The carrying bars 7A are slipped-under and raised from the remaining-stack lifted rail 14 until the remaining stack H is borne by the carrying bars 7A.

IV. The pallet P is lowered and removed from the sheet feeder 2.

V. The remaining-stack is continuously further raised by means of the remaining-stack lifting unit 5 for the singling of the sheet.

VI. A new sheet stack S is installed in the sheet feeder 2 and is lifted by means of the main stack-lifting mechanism.

VII. On contacting of the upper side of the sheet stack S with the underside of the carrying bars 7A the pulling operation of the carrying bars 7A is initiated.

VIII. The carrying bars 7A are pulled out singly or in pairs from inside outward between remaining stack H and sheet stack S.

IX. The remaining stack H is deposited continuously from the inside outward on the spacing bars 7B.

X. The remaining-stack lifting rail 14 becomes free, the remaining-stack carrying device 3 no longer takes on any load, the remaining spacing bars 7B still have only a control function for the stack unification.

XI. The spacing bars 7B are continuously drawn out from the inside outward between remaining-stack and sheet stack S.

XII. The remaining-stack H is deposited continuously from the inside outward on the upper side of the sheet stack S.

In a modified version of the run-off the procedure is as follows:

I. The remaining-stack carrying device 3, after the pulling of the carrying bars 7A and spacing bars 7B, is immediately lowered to the stack lower edge of the new sheet stack S.

II. The carrying bars 7A and spacing bars 7B are introduced into the grooves of the pallet P, their thrusting-in path being less than the total thrusting-in path.

III. The remaining-stack carrying device 3 is lifted load-free synchronized with the sheet stack S.

IV. On reaching the limit height of the sheet stack S the carrying bars 7A and the spacing bars 7B in the frame are slid in, up to the total sliding-in length (the rear side of the sheet stack S remaining free toward the remaining-stack carrying device 3).

V. The remaining stack lifting rail takes over the carrying bars 7A.

VI. The run-off is continued as described above.

The entire run-off has the advantage that the remaining-stack H continuously approaches the sheet stack S, so that no jump points arise in the removing of the remaining-stack bars 7, which have a troublesome effect on the sheet singling or in the moving-out of the sheets from the sheet feeder 2, or that could even interrupt the operating run-off. This holds first of all for the steady follow-up of the upper side of the stack with respect to the sheet singling arrangement, where a spacing is to be maintained within a tolerance range. Further this holds for the moving-off of sheets after the singling, since on the front edge of the sheet stack S or remaining-stack H there are provided control means, for example a so-called sheet flap, which frees or blocks the sheet path. Here, too, a determined height tolerance is to be maintained, so that the sheet front edge in the moving-off does not strike through the thrusting movement, and is therewith upset or upended.

The pulling movement, in each case when only two remaining-stack bars 7 simultaneously likewise cannot affect the position of the sheets in the sheet plane in the stack unification zone. For this reason it is possible to dispense with retaining measures which might damage the sheet.

In a further form of execution, it can provided not to use all of the remaining-stack carrying bars 7. Thus the spacing bars can be omitted in the case of very thick sheet materials, which in consequence of their stability sink only slowly into the interspace that becomes ever larger between the sheet stack S and the remaining stack H. Therewith the changing process is accelerated, since time for the pulling of the spacing bars 7B is saved.

Likewise, carrying bars 7A can be omitted in pairs in the middle of the stack, so that the auxiliary stack H there sinks immediately onto the spacing bars 7B. The adjusting process on the stack surface in relation to the singling device can be supported by an at first slow lowering of the pallet P.

For these measures the corresponding remaining-stack bars 7 do not have to be removed. It suffices to uncouple or to block the corresponding drive means. These remaining-stack bars 7 then, of course, are likewise not driven into the grooves of the pallet P before the stack change.

What is claimed is:

1. A process for automatically and continuously changing a sheet stack in a sheet feeder of a sheet-processing machine including a remaining-stack carrying device having remaining-stack bars, the sheet stack having a pair of opposing stack edges and a middle area interposed between the opposing stack edges, the stack changing process comprising the steps of:

temporarily receiving a remaining stack from a pallet on the remaining-stack bars by sliding the remaining-stack bars underneath said remaining stack from a common side of the stack into a stack position, continuously raising said remaining stack with the remaining-stack bars, and depositing said remaining stack on a newly fed-in sheet stack which has been moved into position below said remaining stack by sequentially removing the remaining-stack bars from the stack position starting with at least one of the remaining-stack bars in the middle area of the sheet stack and then progressively removing others of the remaining stack bars progressing outwardly to the remaining-stack bars adjacent the opposing stack of the sheet stack.

2. The process of claim 1 including sliding the remaining stack bars underneath said remaining stack from a rear side of the stack in relation to a direction in which sheets are removed from the stack by the sheet feeder.

3. The process of claim 1 including removing the remaining stack bars in pairs.

4. A process for automatically and continuously changing a sheet stack in a sheet feeder of a sheet-processing machine including a remaining-stack carrying device having remaining-stack bars, the sheet stack having a pair of opposing stack edges and a middle area interposed between the opposing stack edges, the stack changing process comprising the steps of:

temporarily receiving a remaining stack from a pallet on the remaining-stack bars by sliding the remaining-stack bars underneath said remaining stack from a common side of the stack into a stack position with said remaining stack resting on a first set of the remaining-stack bars in a position above a second set of the remaining-stack bars, continuously raising said remaining stack with the remaining-stack bars and depositing said remaining stack on a newly fed-in sheet stack which has been moved into position below said remaining stack by sequentially removing the first set of remaining stack bars from the stack position starting with at least one of the remaining stack bars of the first set arranged in the middle area of the sheet stack and progressing outwardly to remaining stack bars of the first set adjacent side edges of the sheet stack such that the remaining stack is deposited on the second set of remaining stack bars, and then sequentially removing the second set of remaining stack bars starting with at least one of the remaining stack bars of the second set arranged in the middle area of the sheet stack and progressing outwardly to remaining stack bars adjacent side edges of the stack such that the remaining stack is thereupon joined with the newly fed-in sheet stack.

5. The process of claim 4 including sliding the remaining stack bars underneath said remaining stack from a rear side of the stack in relation to a direction in which sheets are removed from the stack by the sheet feeder.

6. The process of claim 4 including removing the remaining stack bars in pairs.

7. The process of claim 4 including sliding said carrying bars a greater distance into said stack than said spacing bars.

8. A device for changing a sheet stack in a sheet feeder of a sheet processing machine, the stack changing device comprising:

a main stack lifting mechanism for raising and lowering of a sheet stack having opposing stack edges and a middle area, a remaining-stack carrying device including remaining-stack bars for temporarily receiving a remaining stack and transferring said remaining stack to a newly fed-in sheet stack, a drive mechanism for slidably moving said remaining stack bars underneath a remaining stack of sheets from a common side of the remaining stack, a remaining-stack lifting mechanism for raising the remaining-stack carrying device, and said drive mechanism being operable for sequentially removing the remaining stack bars from the remaining stack starting with at least one of the remaining stack bars in the middle area of the sheet stack and progressing outwardly to the remaining stack bars adjacent the opposed stack edges of the sheet stack.

9. The stack changing device according to claim 8 in which said remaining stack bars comprise carrying bars and spacing bars, said carrying bars and spacing bars being arranged in alternating relation to each other, and said drive mechanism being operable for sequentially removing the carrying bars and then sequentially removing said spacing bars.

10. The stack changing device according to claim 9 in which said spacing bars have upper sheet receiving surfaces disposed below the upper sheet receiving surfaces of said carrying bars.

11. The stack changing device according to claim 9 in which said carrying bars are longer in length than said spacing bars.

12. The stack changing device according to claim 9 wherein each of the carrying bars have a thickness and a length which is different than the thickness and length of each of the spacing bars.

13. The stack changing device according to claim 12 wherein each of the carrying bars is relatively longer than each of the spacing bars.

14. The stack changing device according to claim 9 wherein each of the spacing bars has a thickness and each of the carrying bars has a different relative thickness.

15. The stack changing device according to claim 14 wherein each of the carrying bars is relatively thicker than each of the spacing bars.

16. A device for changing a sheet stack in a sheet feeder of a sheet-processing machine, the stack changing device comprising:

a main stack lifting mechanism for raising and lowering of a sheet stack having a pair of opposing stack edges and a middle area interposed between the opposing stack edges, a remaining-stack carrying device including remaining-stack bars having different relative thicknesses for temporarily receiving a remaining stack and transferring said remaining stack to a newly fed-in sheet stack, a drive mechanism for slidably moving said remaining stack bars underneath a remaining stack of sheets from a common side of the remaining stack, a remaining-stack lifting mechanism for raising the remaining-stack carrying device, and said drive mechanism being operable for sequentially removing the relatively thicker remaining stack bars such that the remaining sheet stack is deposited on the relatively thinner remaining stack bars, and then sequentially removing the relatively thinner remaining stack bars such that the remaining stack is thereupon deposited on a newly fed-in sheet stack.

17. The stack changing device according to claim 16 wherein the remaining-stack bars have two different relative thicknesses and are arranged in an alternating symmetrical arrangement based on their thickness over the width of the remaining-stack carrying device.

18. The stack changing device according to claim 16 wherein the remaining-stack bars have two different relative thicknesses and lengths and are arranged in an alternating symmetrical arrangement based on their thickness and length over the width of the remaining-stack carrying device.

19. The stack changing device according to claim 16 wherein the remaining-stack bars comprise carrying bars and spacing bars and each of the carrying bars are relatively thicker than each of the spacing bars.

20. The stack changing device according to claim 16 wherein the remaining-stack bars comprise carrying bars and spacing bars and that the carrying bars are relatively longer than the spacing bars.

21. A device for changing a sheet stack in a sheet feeder of a sheet-processing machine, the stack changing device comprising:

a main stack lifting mechanism for raising and lowering of a sheet stack having a pair of opposing stack edges and a middle area interposed between the opposing stack edges, a remaining-stack carrying device having remaining-stack bars including first remaining stack bars having a relatively high stack receiving surface and second remaining stack bars having a relatively low stack receiving surface, a drive mechanism for slidably moving said remaining stack bars underneath a remaining stack of sheets from a common side of the remaining stack, a remaining-stack lifting mechanism for raising the remaining-stack carrying device, and said drive mechanism being operable for sequentially removing the first remaining stack bars such that the remaining stack is deposited on the second remaining stack bars, and then sequentially removing the second remaining stack bars such that the remaining stack is thereupon deposited on a newly fed-in sheet stack.

* * * * *